US006111174A

United States Patent [19]

Oba et al.

[11] Patent Number: 6,111,174

[45] Date of Patent: Aug. 29, 2000

[54] RELEASED KEY VELOCITY ESTIMATOR, METHOD USED THEREIN AND INFORMATION STORAGE MEDIUM STORING PROGRAM SEQUENCE FOR IT

[75] Inventors: Yasuhiko Oba; Takashi Tamaki; Yuji Fujiwara, all of Hamamatsu, Japan

[73] Assignee: Yamaha Corporation, Hamamatsu, Japan

[21] Appl. No.: 09/006,753

[22] Filed: Jan. 14, 1998

[30] Foreign Application Priority Data

| | | | |
|---|---|---|---|
| Jan. 14, 1997 | [JP] | Japan | 9-005005 |
| Feb. 25, 1997 | [JP] | Japan | 9-041227 |
| Jul. 2, 1997 | [JP] | Japan | 9-177362 |

[51] Int. Cl.[7] ..... G10F 1/02

[52] U.S. Cl. ..... 84/21; 84/13; 84/461; 84/626; 84/658

[58] Field of Search ..... 84/21, 461, 13, 84/20, 22, 658, 615, 626

[56] References Cited

U.S. PATENT DOCUMENTS

| | | | |
|---|---|---|---|
| 5,022,301 | 6/1991 | Stahnke | 84/21 |
| 5,691,489 | 11/1997 | Fujiwara et al. | 84/21 |

*Primary Examiner*—Robert E. Nappi
*Assistant Examiner*—Shih-yung Hsieh
*Attorney, Agent, or Firm*—Graham & James LLP

[57] ABSTRACT

An automatic player piano has a released key velocity estimator for modifying the constant released key velocity of a piece of music data information to a target released key velocity; a memory stores relation between the target key velocity estimator and other key-touch factors such as a final hammer velocity and a time interval between an impact timing and a key release timing, the released key velocity estimator supplies the key-touch factors to the memory so as to read out the target key velocity estimator, and modifies the piece of music data information so as to indicate the target released key velocity.

6 Claims, 8 Drawing Sheets

RELEASED KEY VELOCITY ESTIMATOR, METHOD USED THEREIN AND INFORMATION STORAGE MEDIUM STORING PROGRAM SEQUENCE FOR IT

FIELD OF THE INVENTION

This invention relates to an automatic playing keyboard musical instrument such as an automatic player piano and, more particularly, to a released key velocity estimator incorporated in the automatic playing keyboard musical instrument, a method of controlling an automatic playing keyboard musical instrument and an information storage medium storing a program sequence for the controlling method.

DESCRIPTION OF THE RELATED ART

An automatic player piano is a compromise between an acoustic piano and an automatic playing system, and the automatic player piano is implemented by solenoid-operated key actuators and a controller. A pianist or the controller plays a tune on an automatic player piano. While the pianist is fingering on the keyboard, the key action mechanisms drive the hammers for rotation, and the hammers strike associated strings so as to produce acoustic sounds. When the keys reach the end positions, the pianist keeps the depressed keys at the end position for a while, and, thereafter, releases the depressed keys. The depressed keys return from the end positions toward the rest positions.

On the other hand, the controller sequentially interprets music data codes representative of an original performance, and selectively supplies a driving signal to the solenoid-operated key actuators. The driving signal energizes the coil of the selected solenoid-operated key actuator, and the energized coil gives thrust to the plunger. The plunger pushes the associated key, and the key turns toward the end position without fingering. Then, the key action mechanism drives the associated hammer for rotation, and the hammer strikes the associated strings so as to produce the acoustic sound. The controller causes the solenoid-operated key actuators to keep the keys at the end positions for a while, and removes the driving signals from the coils. The plungers are retracted into the coils, and the keys return to the rest positions.

The pianist varies the key touch for artistic representation, and the fidelity is one of the technical goals of the automatic player piano. While the automatic player piano is reproducing an original performance, the controller changes the magnitude of the driving signal depending upon the intensity of the strike during the original performance, and the plungers drive the keys for rotation at different velocities toward the strings. However, the prior art music data codes do not contain any piece of music data information representative of the released key velocity. For example, a released key velocity does not form any part of the music data codes formatted in accordance with the MIDI (Musical Instrument Digital Interface) standards. For this reason, when the controller removes the driving signals from the coils, the plungers are retracted into the coils without any control, and the keys return to the rest positions at a constant released key velocity. In order words, the prior art automatic player piano takes the depressed key touch into account, and ignores the released key touch.

SUMMARY OF THE INVENTION

It is therefore an important object of the present invention to provide a released key velocity estimator available for an automatic player keyboard musical instrument.

It is also an important object of the present invention to provide a method of controlling the released key velocity estimator.

It is yet another important object of the present invention to provide an information storage medium storing a program sequence for the controlling method.

In accordance with one aspect of the present invention, there is provided a released key velocity estimator incorporated in a keyboard musical instrument controlled with pieces of music data information and comprising a memory means for storing relation between a released key velocity and key-touch factors and a released key velocity determiner connected to the memory means and supplying pieces of data information representative of the key-touch factors to the memory means so as to read out the released key velocity from the memory means.

In accordance with another aspect of the present invention, there is provided method for estimating a released key velocity comprising the steps of preparing relation between a released key velocity and key-touch factors in an information storage medium, and supplying a piece of control data information representative of the key-touch factors to the information storage medium so as to specify the released key velocity.

In accordance with yet another aspect of the present invention, there is provided an information storage medium storing a program sequence for estimating a released key velocity of a key incorporated in a keyboard musical instrument on the basis of relation between the released key velocity and key-touch factors of pieces of music data information.

BRIEF DESCRIPTION OF THE DRAWINGS

The features and advantages of the released key velocity estimator, the controlling method and the information storage medium storing a program sequence for the controlling method will be more clearly understood from the following description taken in conjunction with the accompanying drawings in which.

DESCRIPTION OF THE PREFERRED EMBODIMENTS

First Embodiment

Figure 1:
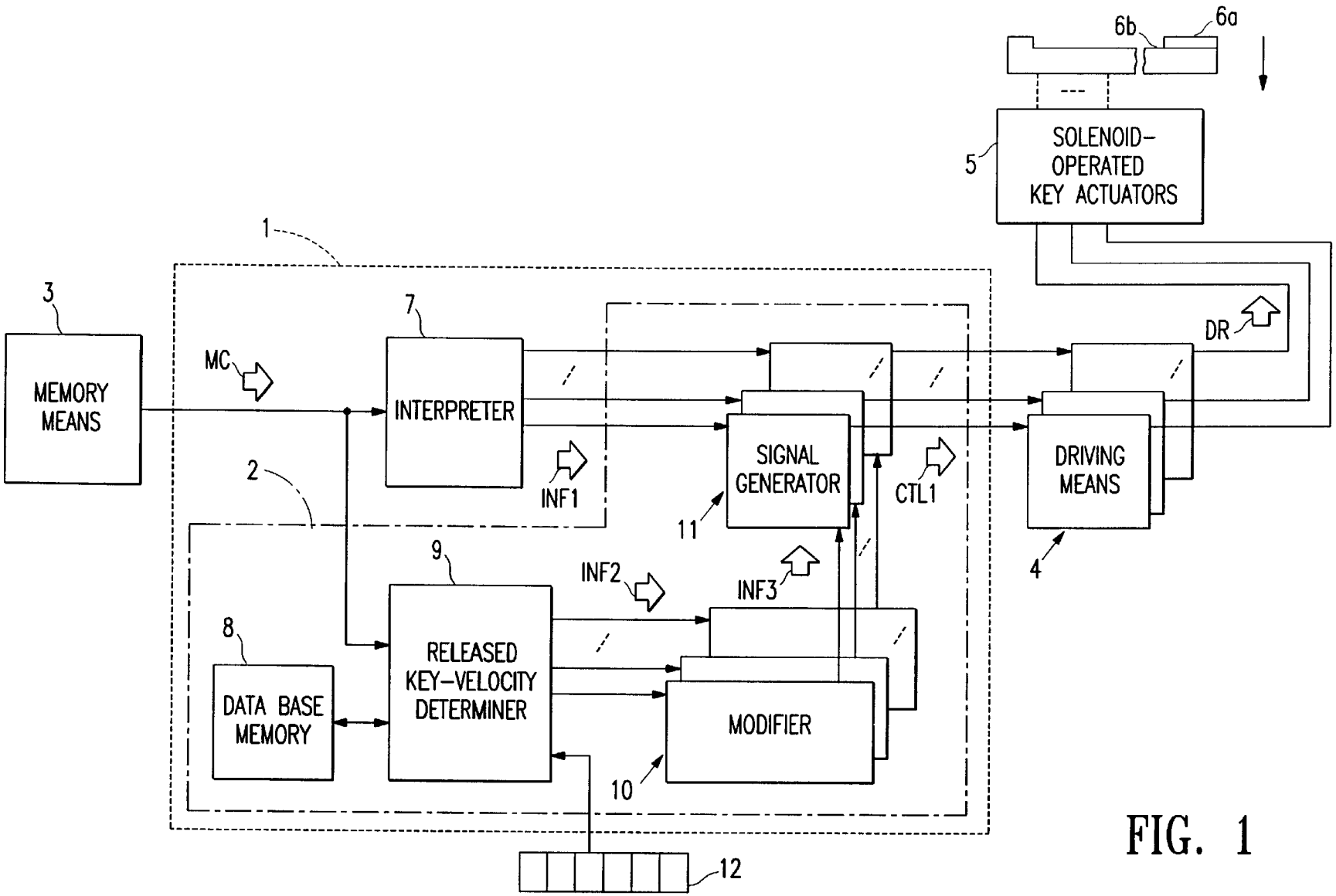
FIG. 1 is a block diagram showing function blocks of a controller incorporated in an automatic player piano according to the present invention.
Figure 2:
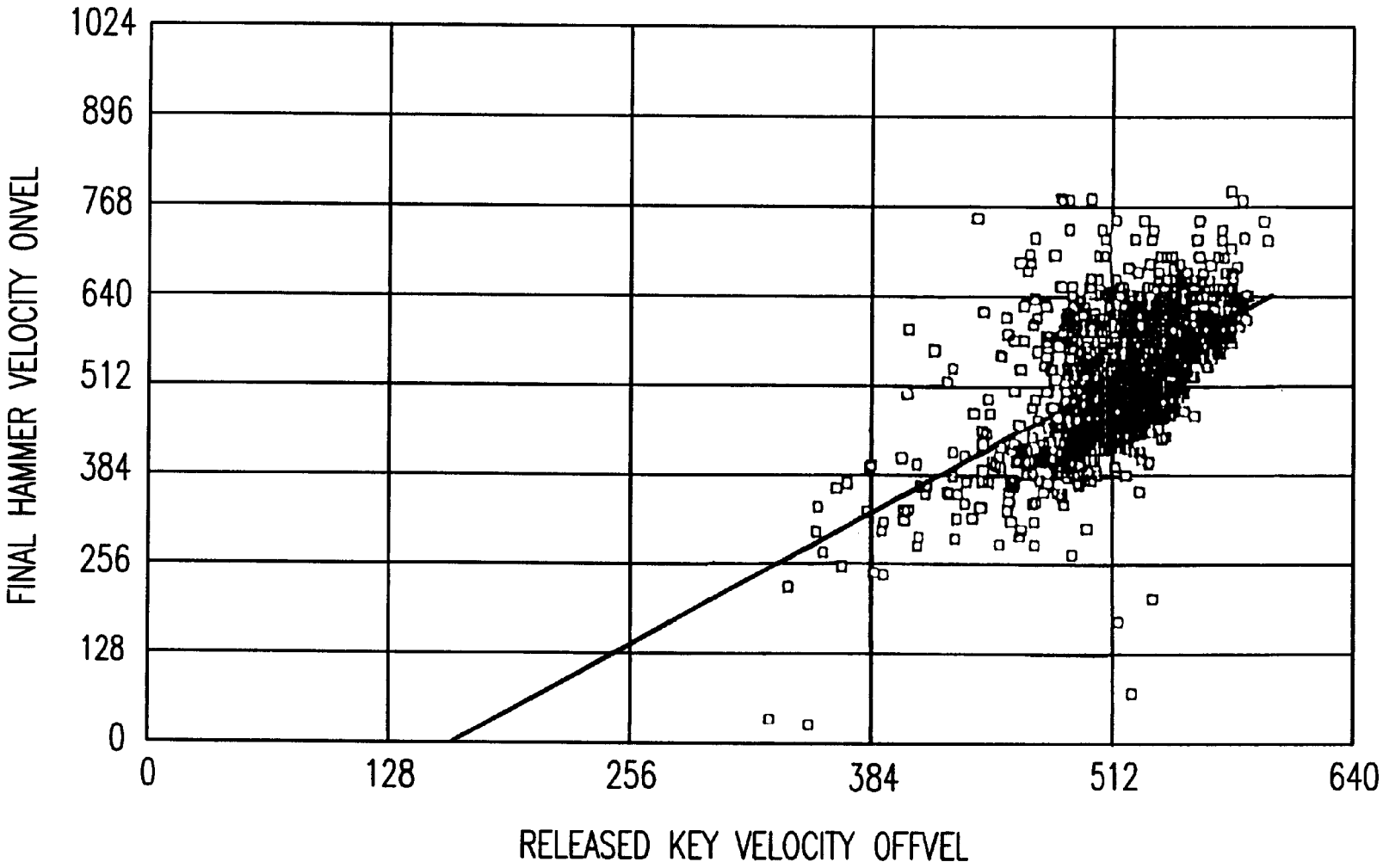
FIG. 2 is a graph showing relation between a final hammer velocity and a released key velocity when time interval between an impact timing and a key release timing is short.
Figure 3:
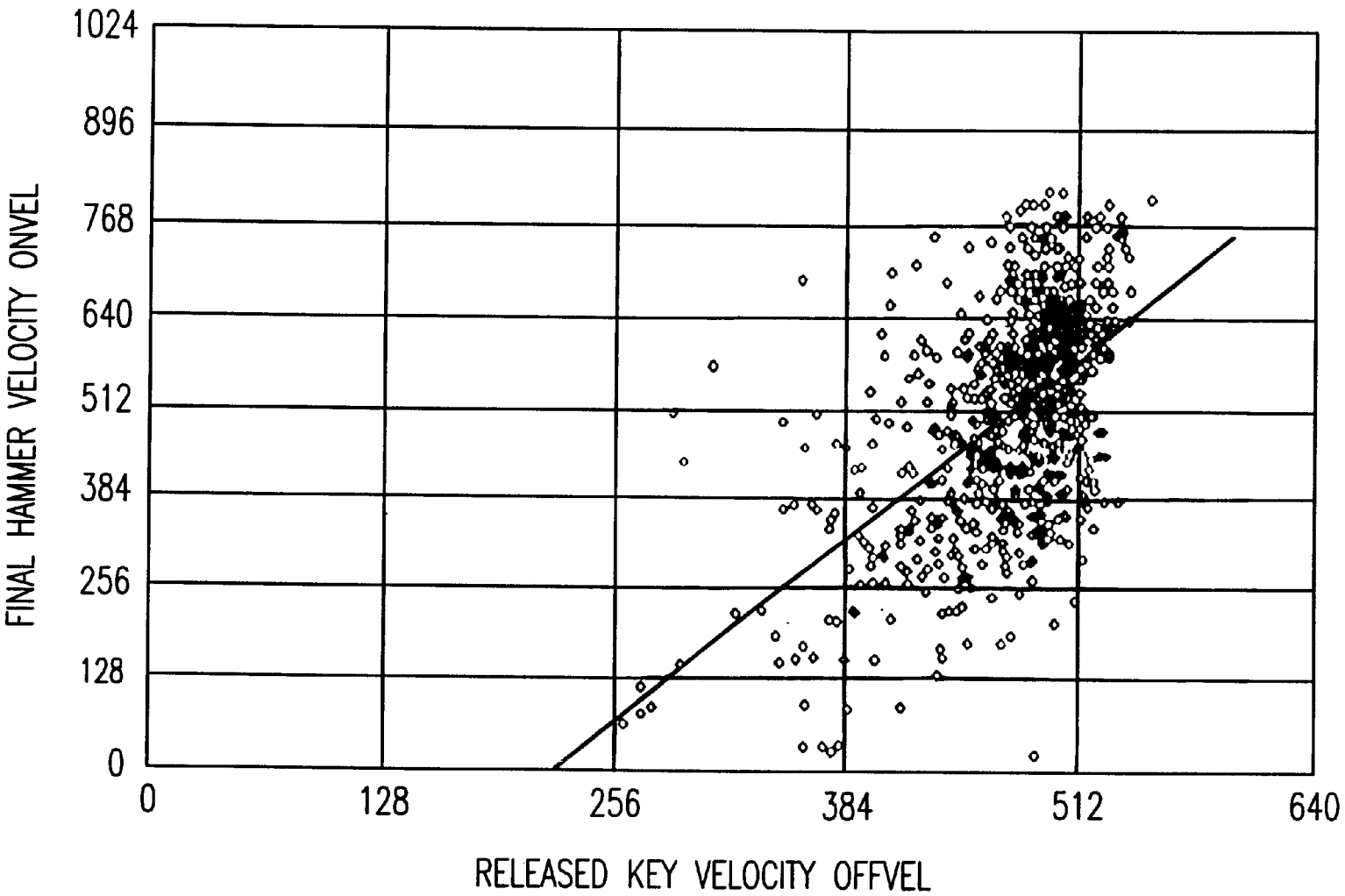
FIG. 3 is a graph showing relation between the final hammer velocity and the released key velocity when the time interval between the impact timing and the key release timing is longer that the time interval in FIG. 2.
Figure 4:
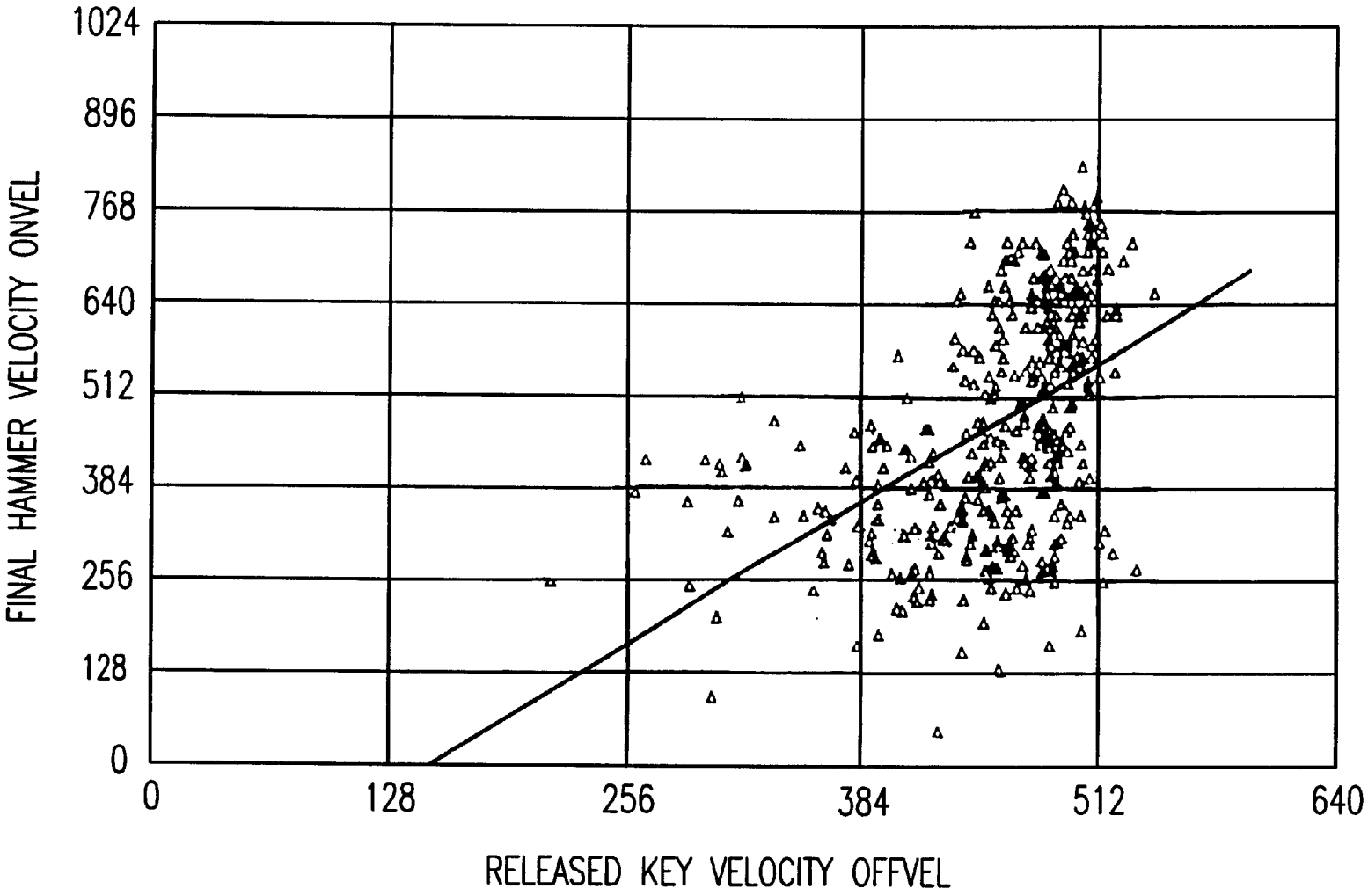
FIG. 4 is a graph showing relation between the final hammer velocity and the released key velocity when the time interval between the impact timing and the key release timing is longer that the time interval in FIG. 3.
Figure 5:
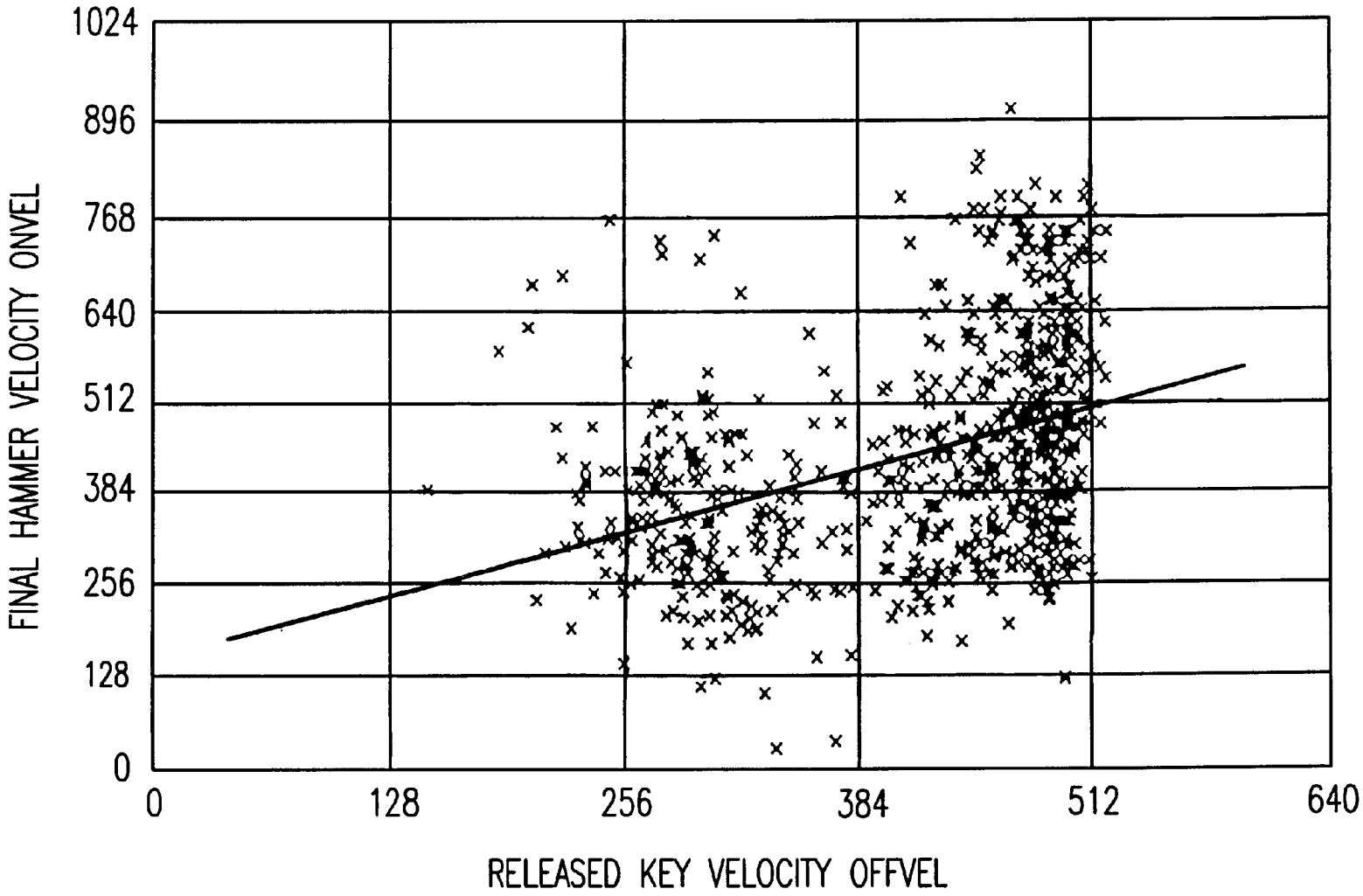
FIG. 5 is a graph showing relation between the final hammer velocity and the released key velocity when the time interval between the impact timing and the key release timing is longer that the time interval in FIG. 4.
Figure 6:
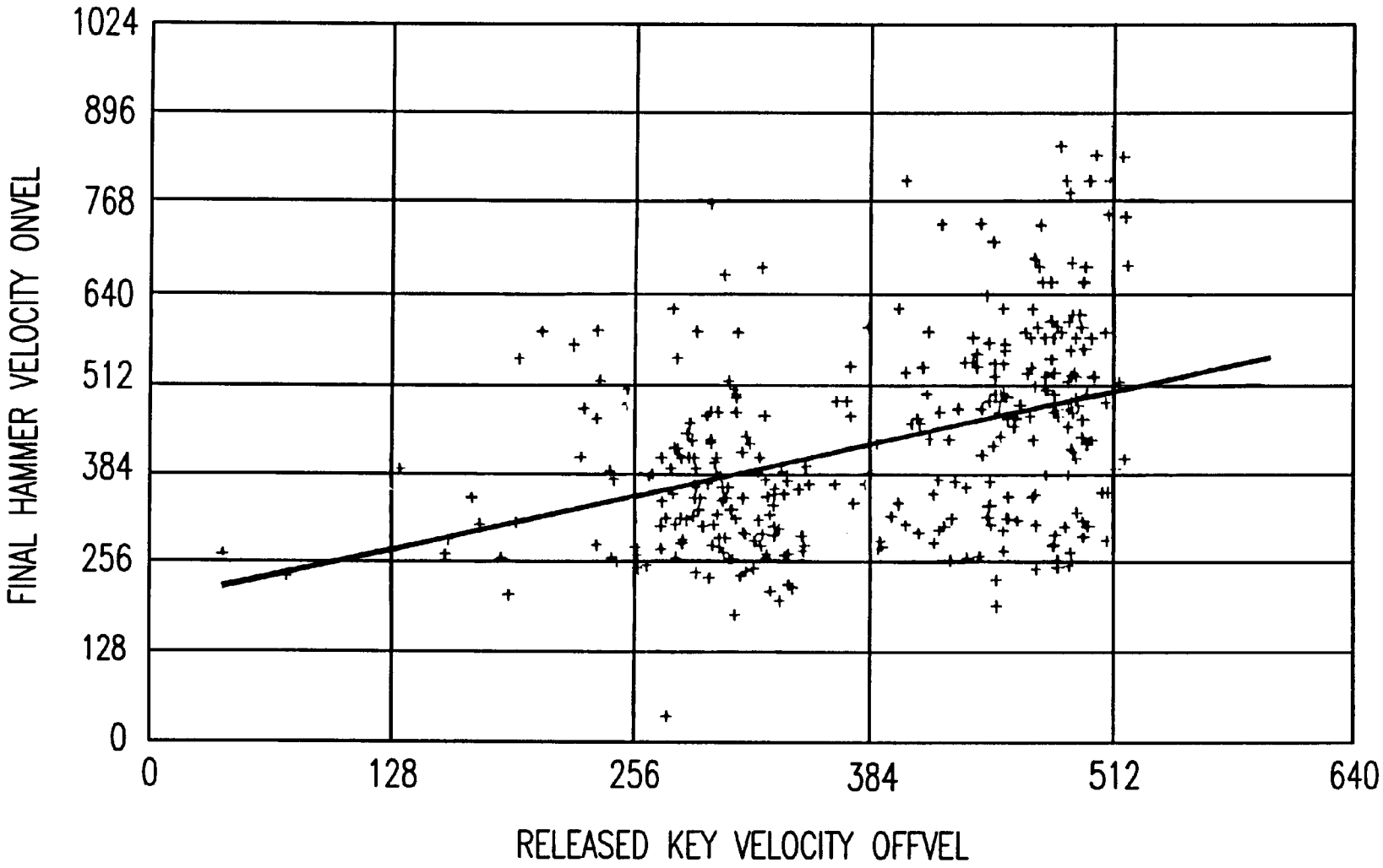
FIG. 6 is a graph showing relation between the final hammer velocity and the released key velocity when the time interval between the impact timing and the key release timing is longer that the time interval in FIG. 5.

FIG. 1 illustrates a controller 1 equipped with a released key velocity estimator 2 embodying the present invention. The controller 1 takes a released key velocity into account, and controls an automatic player piano in a real time fashion.

Structure of Controller

FIG. 1 illustrates a controller 1 equipped with a released key velocity estimator 2 embodying the present invention. The controller 1 controls an automatic player piano in a real time fashion.

The controller 1 is connected to a memory means 3 implemented by random access memory devices, and pieces of music data information MC are stored in the memory means 3. The pieces of music data information MC are representative of an original performance, and may be in the form of digital code. A central processing unit, a read only memory, a rewritable memory and various interfaces form in combination the controller 1, and a part of the memory unit 3 may be used as the rewritable memory.

The controller 1 is further connected to a plurality of driving means 4. The driving means 4 are respectively associated with solenoid-operated key actuators 5, and the solenoid-operated key actuators 5 drive black/white keys 6*a*/6*b* of an acoustic piano for rotation. In this instance, the driving means 4 is implemented by a PWM (Pulse Width Modulation) circuit, and supplies a driving pulse signal DR to the associated solenoid-operated key actuator 5. The solenoid-operated key actuator 5 includes a solenoid connected to the associated PWM circuit 4 and a plunger projectable from and retractable into the solenoid, and the plunger is held in contact with the lower surface of the rear end portion of the associated black/white key 6*a*/6*b*. The driving pulse signal DR energizes the solenoid of the solenoid-operated key actuator 5, and the solenoid generates magnetic field. The magnetic field gives thrust to the plunger, and the plunger upwardly pushes the rear end portion of the associated black/white key 6*a*/6*b*. As a result, the black/white key 6*a*/6*b* is driven for rotation without fingering, and drives associated one of hammers through a key action mechanism for rotation toward strings.

The function of the controller 1 is divided into the following blocks. The first function block 7 is called as "interpreter". The interpreter 7 reads out the pieces of music data information MC from the memory means 3, and producing a piece of driving data information INF1. The pieces of music data information MC are representative of not only a motion of each depressed key 6*a*/6*b* but also a motion of each released key 6*a*/6*b*, and the interpreter 7 supplies the pieces of driving data information INF1 through the released key velocity estimator 2 to the driving means 4. The memory means 3, the interpreter 7 and the driving means 4 are same as those of the prior art controller.

The released key velocity estimator 2 produces a driving control signal CTL1 for depressed black/white keys 6*a*/6*b* from the piece of driving data information INF1, and the driving control signal CTL1 for released black/white keys 6*a*/6*b* from the piece of driving data information INF1 and a piece of control data information INF3. The released key velocity estimator 2 supplied the driving control signal CTL1 to the controlling means 4, and the controlling means 4 regulates the driving pulse signal DR to a target magnitude. The released key velocity estimator 2 includes the following function blocks 8, 9, 10 and 11.

The function block 8 is called as "data base memory". The data base memory 8 stores a plurality of tables each representative of relation between a target released key velocity OFFVEL and key-touch factors such as a final hammer velocity ONVEL, time interval GT between an impact timing and a key release timing, a depressed key velocity, time interval between the impact timing and a key depressing timing and time interval between the key depressing timing and the key release timing. The plurality of tables are assigned to different fields such as, for example, classic music, jazz and popular music.

The function block 9 is called as "released key velocity determiner". The released key velocity determiner 9 is connected to the memory means 3, a selecting switch array 12 and the data base memory 8. The selecting switch array 12 is used for selecting one of the fields and, accordingly, one of the tables in the data base memory 8. The memory means 3 supplies the pieces of music data information MC to the released key-velocity determiner 9, and the released key velocity determiner 9 extracts the key-touch factors from the pieces of music data information MC. The released key velocity determiner 9 accesses selected one of the tables stored in the data base memory 8, and determines the released key velocity corresponding to the key-touch factors. The released key-velocity determiner 9 produces a piece of target key velocity data information INF2 representative of the target released key velocity OFFVEL.

The released key velocity determiner 9 has a buffer area for storing the final hammer velocities and the impact timings together with the key codes assigned to the black/white keys 6*a*/6*b* to be depressed. When pieces of music data information MC represents an instruction for depressing a black/white key 6*a*/6*b*, the released key-velocity determiner 9 writes the impact timing, the final hammer velocity and the key code assigned to the black/white key 6*a*/6*b* in the buffer area. When the released key-velocity determiner 9 receives a piece of music data information MC representative of an instruction for releasing the black/white key 6*a*/6*b*, the released key velocity determiner 9 determines the target released key velocity for the black/white key 6*a*/6*b* as will be described hereinlater, and, thereafter, erases the final hammer velocity, the impact timing and the key code assigned to the released black/white key 6*a*/6*b* from the buffer area.

The function block 10 is called as "modifiers". The modifiers 10 are respectively associated with the black/white keys 6*a*/6*b*, and are connected to the released key-velocity determiner 9 so as to receive the piece target key velocity data information INF2 from the released key-velocity determiner 9. When the target released key velocity OFFVEL is determined for a black/white key 6*a*/6*b*, the released key-velocity determiner 9 supplies the piece of target key-velocity data information INF2 to the modifier 10 associated with the black/white key 6*a*/6*b*, and the modifier 10 produces the piece of control data information INF3 from the piece of target key velocity data information INF2 for the black/white key 6*a*/6*b*. The piece of control data information INF3 is representative of a magnitude of the driving pulse signal DR for imparting the final hammer velocity ONVEL to a released black/white key 6*a*/6*b*.

The function blocks 11 are identified as "signal generators". The signal generators 11 are connected to the interpreter 7, the modifier 10 and the plurality of driving means 4, and are respectively associated with the plurality of driving means 4 and, accordingly, the black/white keys 6*a*/6*b*. When a signal generator 11 receives the piece of driving data information INF1 for a depressed black/white key 6*a*/6*b* from the interpreter 7, the signal generator 11 produces the driving control signal CTL1 from the piece of driving data information INF1, and supplies the driving control signal CTL1 to the associated driving means 4. When a signal generator 11 receives the piece of driving data information INF1 and the piece of control data information INF3 for the associated black/white key 6*a*/6*b* from the interpreter 7 and the modifier 10, the signal generator 11 produces the control signals CTL1 representative of the target released key velocity OFFVEL, and supplies the control signal CTL1 to the associated driving means 4.

Tables Stored in Data Base Memory

Description is hereinbelow made on how the manufacturer produces the tables stored in the data base memory 8. Although the tables are assigned to different fields, the structure of the tables is similar, and one of the tables is described for the sake of simplicity. The table is assumed to define relation between the target released key velocity OFFVEL and two key-touch factors. The two key-touch factors are the time interval GT between the impact timing and the key release timing and the final hammer velocity ONVEL.

A suitable measuring equipment is installed in an acoustic piano for detecting the final hammer velocity ONVEL, the released key velocity OFFVEL and the time interval GT, and a pianist plays several tunes in the field on the piano.

FIGS. 2 to 6 are graphs obtained through the performance. The measuring equipment measured the final hammer velocity ONVEL and the released key velocity OFFVEL at the resolution corresponding to 10 bits, and plotted the relation between the final hammer velocity ONVEL and the released key velocity OFFVEL in the figures. The time interval GT was increased from FIG. 2 to FIG. 6, and the relation was approximated by plots PL1, PL2, PL3, PL4 and PL5 in FIGS. 2 to 6, respectively. Plots PL1 to PL5 indicated existence of correlation between the final hammer velocity ONVEL and the released key velocity OFFVEL. The gradient of plots PL1 to PL5 were varied together with the time interval GT. This meant correlation between the final hammer velocity ONVEL, the time interval GT and the released key velocity OFFVEL. The present inventors concluded that the released key velocity OFFVEL was estimated from the final hammer velocity ONVEL and the released key velocity OFFVEL. The present inventors measured the final hammer velocity ONVEL, the released key velocity OFFVEL and the time interval GT for the other fields, and completed the tables stored in the data base memory 8.

It is possible to store the correlation in the data base memory in various formats. For example, the relation between the final hammer velocity ONVEL and the released key velocity OFFVEL is prepared for individual time intervals GT. Otherwise, the probability distribution of the released key velocity OFFVEL is calculated in terms of the final key velocity ONVEL and the time interval GT, and is stored in the data base memory 8.

In the above described experiment, the correlation was approximately by linear lines PL1 to PL5. However, the correlation may be approximated by any kind of non-linear line.

Behavior of Automatic Player Piano

Assuming now that a listener selects one of the fields and instructs the automatic player piano to reproduce an original performance, the pieces of musical data information MC are successively read out from the memory means 3, and are supplied to the controller 1. The pieces of music data information MC teaches at least a key code assigned to a black/white key 6*a*/6*b* to be actuated, the final hammer velocity ONVEL, a key-on event, a key-off event, the impact timing, the key release timing to the controller 1. However, there is not any piece of music data information MC representative of the released key velocity OFFVEL.

The pieces of music data information MC are supplied to the interpreter 7 and the released key-velocity determiner 9. The interpreter 7 reads out the impact timings and the key release timings in time order, and determines the black/white keys 6*a*/6*b* to be pushed and released and the final hammer velocity for the black/white keys 6*a*/6*b* to be pushed. The timing for reading out from the memory means 3 is hereinbelow referred to as "read-out timing".

When a piece of music data information MC representative of a black/white key 6*a*/6*b* to be depressed is read out from the memory means 3 together with the piece of music data information representative of the final hammer velocity, the interpreter 7 instructs the signal generator 11 associated with the black/white key 6*a*/6*b* to produce the driving control signal CTL1 representative of the magnitude of the driving pulse signal DR to impart the final hammer velocity to the black/white key 6*a*/6*b* to be depressed. The released key-velocity determiner 9 writes the final hammer velocity ONVEL and the impact timing into the buffer area together with the key code assigned to the black/white key 6*a*/6*b* to be depressed. The driving means 4 regulates the pulse with of the driving signal DR to appropriate value, and supplies the driving signal DR to the solenoid of the key actuator 5 associated with the black/white key 6*a*/6*b* to be pushed. The solenoid generates magnetic field, and the magnetic field gives thrust to the plunger. The thrust projects the plunger, and the plunger pushes the rear portion of the black/white key 6*a*/6*b*. The black/white key 6*a*/6*b* turns so as to actuate the associated key action mechanism, and the key action mechanism drives the associated hammer for rotation. The hammer escapes from the key action mechanism, and strikes the associated strings at the target hammer velocity. After the strike against the strings, the driving means 4 reduces the magnitude of the driving signal DR to a certain value, and the solenoid-operated key actuator 5 keeps the black/white key 6*a*/6*b* at the end position.

The actual impact with the hammer is delayed from the arrival of the driving control signal CTL1 at the driving means 4, and the time interval is called as "attack delay". The attack delay is inversely proportional to the final hammer velocity. If the signal generators 11 distribute the driving control signal CTL1 to the driving means 4 associated with the black/white keys 6*a*/6*b* to be depressed immediately after the interpretation of the pieces of music data information MC, the intervals between the acoustic sounds become different from those of the original performance. For this reason, time delay of, for example, 500 milliseconds is introduced between the read-out timing and the actual impact timing/actual key release timing, and the signal generator 11 increased the driving signal DR to a certain value for the final hammer velocity earlier than the impact timing by the attack delay. The driving signal DR is decreased to a certain value at the key release timing. The control sequence for the depressed black/white keys 6*a*/6*b* are same as that of the prior art.

When the interpreter 7 reads out the pieces of music data information representative of an instruction for releasing a black/white key 6*a*/6*b* from the memory means 3, the released key-velocity determiner 9 checks the buffer area to look for the key code assigned to the black/white key 6*a*/6*b* already stored together with the final hammer velocity ONVEL and the impact timing. The released key-velocity determiner 9 reads out the final hammer velocity ONVEL and the impact timing from the buffer area, and calculates the time interval GT between the impact timing and the key release timing. The released key-velocity determiner 9 supplies the time interval GT and the final hammer velocity ONVEL to the data base memory 8. The data base memory 8 selects a released key velocity OFFVEL corresponding to the final hammer velocity ONVEL and the time interval GT from the selected table, and supplies the released key velocity OFFVEL to the released key-velocity determiner 9. The driving pulse signal DR is decreased to a certain value at the key release timing. The solenoid-operated key actuator 4 is controlled for the depressed black/white key 6*a*/6*b* as similar to the prior art.

The released key-velocity determiner 9 produces the piece of target key-velocity data information INF2 to the modifier 10, and supplies the piece of target key velocity data information INF2 to the modifier 10. The modifier 10 produces the piece of control data information INF3 representative of the magnitude of the driving pulse signal DR corresponding to the target released key velocity OFFVEL from the piece of target key velocity data information INF2, and supplies the piece of control data information INF3 to the signal generator 11 associated with the black/white key 6*a*/6*b* to be released at the key release timing.

The signal generator 11 adds the value of the piece of driving control data information INF3 to the value of the piece of driving control data information INF1, and supplies the driving control signal CTL1 representative of the sum of the values to the driving means 4 associated with the black/white key 6*a*/6*b* to be released. The driving means 4 varies the driving pulse signal DR, and regulates the black/white key 6*a*/6*b* to the target released key velocity.

The driving pulse signal DR is increased to the value for the final hammer velocity ONVEL at the certain timing earlier than the impact timing by the attack delay, and is decreased to the value for the target released key velocity at the key release timing. As a result, the driving means 4 causes the associated black/white key 6*a*/6*b* to strike the associated strings in accordance with the impact timing and the final hammer velocity ONVEL and release the black/white key 6*a*/6*b* in accordance with the key release timing and the target released key velocity OFFVEL estimated on the basis of the final hammer velocity ONVEL, the impact timing and the key release timing.

Although the released key velocity estimator 2 consumes short time period for determining the target released key velocity OFFVEL, the impact timing and the key release timing are delayed from the read-out timings, and the controller 1 controls the driving means 4 at the key release timings.

If the certain value in the predetermined period after the key release timing supplied from the interpreter 7 is assumed to be zero, the modifiers 10 can ignore the time period.

Figure 7:
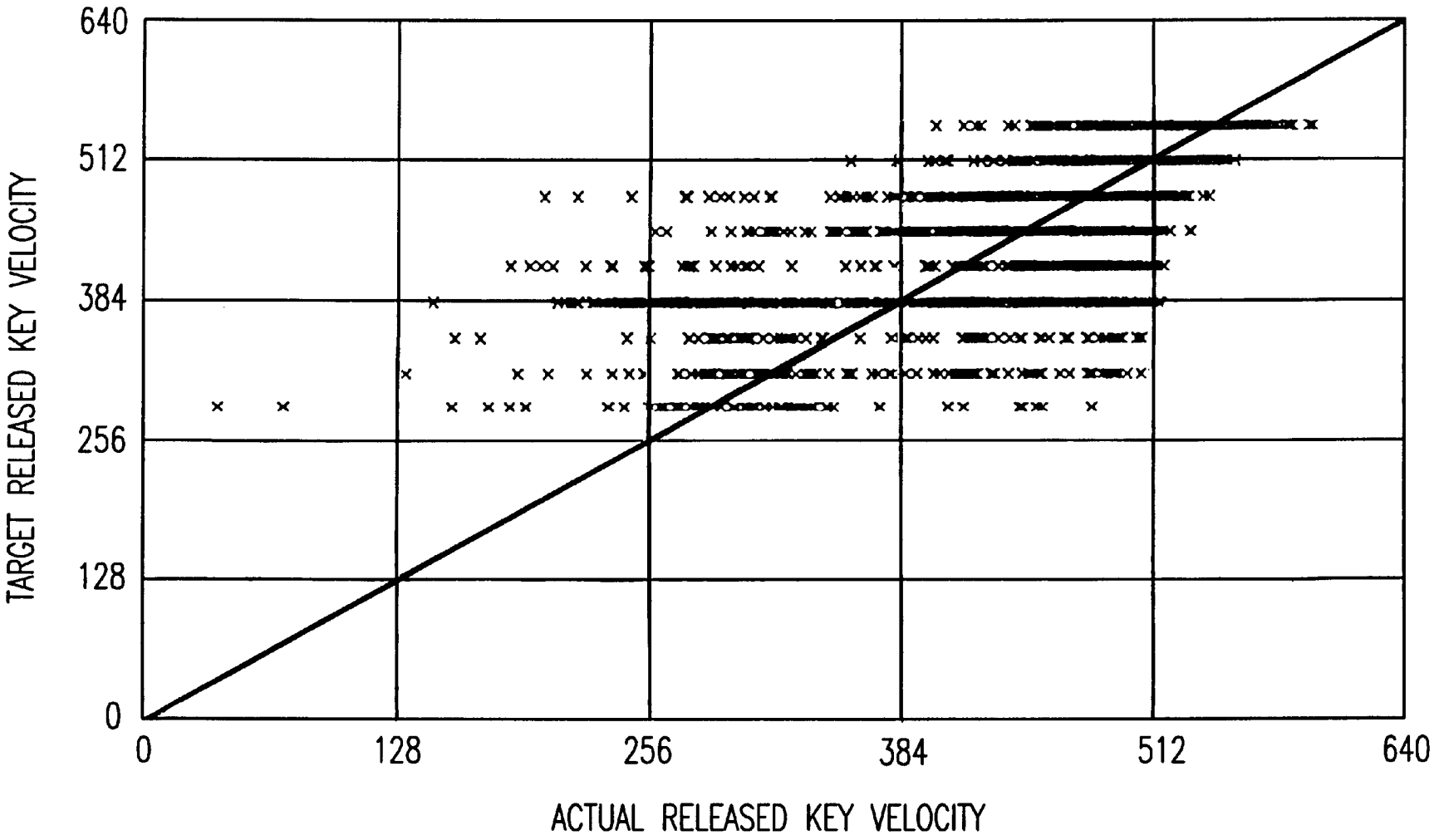
FIG. 7 is a graph showing relation between a target released key velocity and an actual released key velocity.

As will be appreciated from the foregoing description, the solenoid-operated key actuator 5 releases the depressed black/white key 6*a*/6*b* at the target released key velocity OFFVEL estimated on the basis of the final hammer velocity, the impact timing and the key release timing. The target released key velocity OFFVEL is close to an actual released key velocity measured during the fingering on the keyboard as shown in FIG. 7. For this reason, the automatic player piano achieves musicality better than that of the prior art automatic player piano, which releases the depressed key at a constant released key velocity. Moreover, the automatic player piano according to the present invention is available for a training a person for good key touch.

Moreover, the released key velocity estimator 2 is added to the controller incorporated in the prior art automatic player piano, and the prior art controller and the other component parts are available for the automatic player piano according to the present invention through remodeling of the controller.

Second Embodiment

Figure 8:
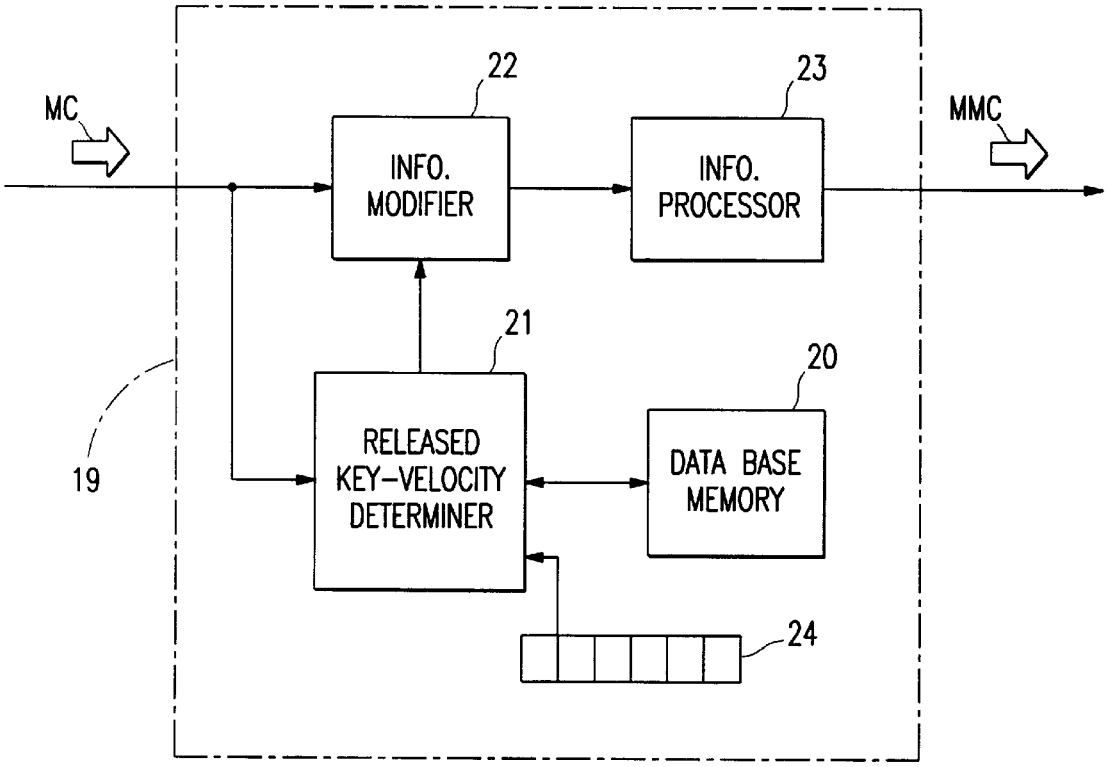
FIG. 8 is a block diagram showing function blocks incorporated in another released key velocity estimator according to the present invention.
Figure 9:
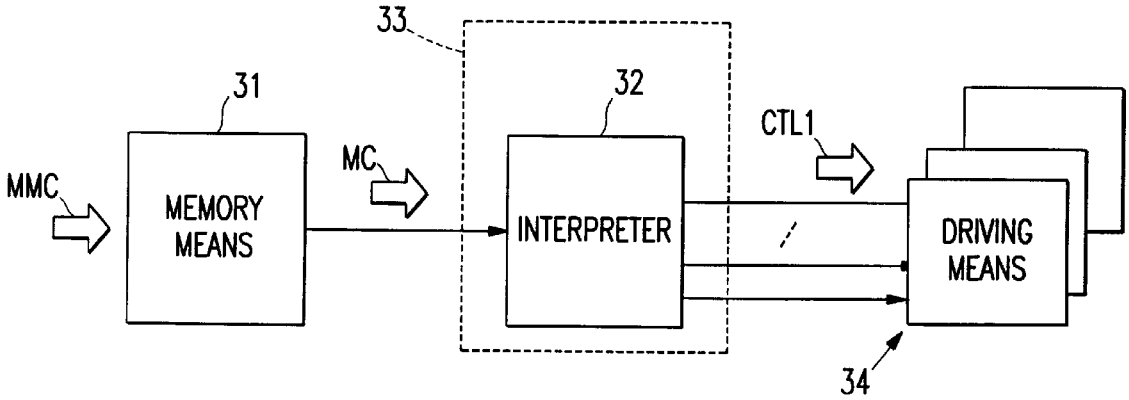
FIG. 9 is a block diagram showing the arrangement of a controller equipped with the released key velocity estimator shown in FIG. 8.

FIG. 8 illustrates another released key velocity estimator 19 embodying the present invention, and the released key velocity estimator 19 is incorporated in an automatic player piano. The released key velocity estimator 19 produces pieces of modified music data information MMC representative of an instruction for depressing a released key on the way toward the rest position. The released key velocity estimator 19 is not expected to process the pieces of music data information in a real time fashion, and supplies the pieces of modified music data information MMC to a memory means 31 corresponding to the memory means 3 of the first embodiment as shown in FIG. 9. Keys and other components of the automatic player piano are labeled with the same references designating corresponding keys and components of the automatic player piano shown in FIG. 1.

Arrangement of Released Key Velocity Estimator

The released key velocity estimator 19 is supplied with the pieces of music data information MC, of the same type as those supplied to the released key velocity estimator 2 of the first embodiment. The released key velocity estimator 19 modifies the pieces of music data information MC for released black/white keys 6*a*/6*b*, and produces the pieces of modified music data information MMC.

The released key velocity estimator 19 comprises a data base memory 20, a released key-velocity determiner 21, an information modifier 22, an information processor 23 and a manipulating switch 24. The manipulating switch 24 is used for selecting one of the fields.

The piece of music data information is supplied in parallel to both of the released key-velocity determiner 21 and the information modifier 22. The data base memory 20 stores the relation between the target released key velocity OFFVEL, the final hammer velocity ONVEL and the time interval GT for various fields, and the released key velocity determiner 21 reads out the target released key velocity from the data base memory 20.

The released key velocity determiner 21 is different from the released key velocity determiner 9 in that the released key-velocity determiner 21 outputs the piece of target key velocity data information INF2 in correspondence to the piece of music data information representative of the key code. The piece of target key velocity data information INF2 and the piece of music data information representative of the key code are supplied in serial to the information modifier 22. This is because of the fact that the released key velocity estimator 19 is not expected to process the pieces of the target key-velocity data information in the real time fashion. The released key velocity estimator 19 is simpler in structure than the released key velocity estimator 2. Of course, the released key velocity estimator 19 may selectively output the piece of target key-velocity data information INF2 from a plurality of output terminals.

The information modifier 22 stores a predetermined number of pieces of music data information MC in an internal buffer, and successively outputs them. When the piece of target released key velocity data information INF2 is supplied from the released key velocity determiner 21 to the information modifier 22 in correspondence to the key code, the information processor reads out the piece of music data information MC representative of the instruction for releasing the black/white key 6*a*/6*b* identified with the key code, and modifies the piece of music data information MC to a piece of music data information MC' representative of an instruction for releasing the black/white key 6*a*/6*b* at the target released key velocity.

The information processor 23 temporarily stores the pieces of music data information MC and the modified piece of music data information MC' in a buffer. The information processor 23 successively interprets the pieces of music data information MC and the modified piece of music data information MC' stored in the buffer, and processes them. The information processor 23 produces pieces of modified music data information MMC, and outputs the pieces of modified music data information MMC. If the piece of music data information represents an instruction for depressing a released key before reaching the rest position, the information processor 23 changes the target released key velocity OFFVEL represented by the modified piece of music data information MC' and the key release timing represented by the piece of music data information MC so as to allow the associated solenoid-operated key actuator 5 to depress the black/white key 6*a*/6*b* at a certain position on the way toward the rest position. The black/white key 6*a*/6*b* which has returned to the certain position makes the solenoid-operated key actuator 5 depress it possible. In this situation, the information processor 23 usually increases the target released key velocity.

As described hereinbefore, the released key velocity estimator 19 is connected to the memory means 31, and the pieces of modified music data information MMC are stored in the memory means 31. The memory means 31 is connected to the interpreter 32 incorporated in a controller 33, and the controller 33 controls driving means 34 associated with the black/white keys 6*a*/6*b* of the automatic player piano. The pieces of music data information MC and the pieces of modified music data information MMC are successively supplied to the interpreter 32, and the interpreter 32 interprets them.

Behavior of Automatic Player Piano

Subsequently, description is made on the behavior of the automatic player piano. The memory means 31 is assumed to store the pieces of music data information MC representative of the key code, the final hammer velocity, the impact timing, the target released key velocity and the key release timing and the pieces of music data information MMC. The pieces of modified music data information MMC have been already described hereinbefore, and it would be clear for how the pieces of modified music data information are produced.

When the automatic player piano is instructed to reproduce an original performance, the controller 33 successively reads out the pieces of music data information MC and the pieces of modified music data information MMC from the memory means 31. The interpreter 32 interprets the pieces of music data information MC and the pieces of modified music data information MMC, and supplies the driving control signal CTL1 to the driving means 34 associated with the black/white keys 6*a*/6*b* to be moved. When the interpreter 32 interprets the pieces of music data information MC representative of the instruction for depressing a black/white key 6*a*/6*b*, the interpreter 32 produces the driving control signal CTL1 corresponding to the final hammer velocity to the driving means 34 associated with the black/white key 6*a*/6*b* at a certain timing earlier than the impact timing by the attack delay. The driving means 34 regulates the driving pulse signal DR to the given magnitude, and supplies the driving pulse signal DR to the associated solenoid-operated key actuator 5. The solenoid-operated key actuator 5 projects the plunger from the coil, and causes the black/white key to turn. The black/white key 6*a*/6*b* actuates the associated key action mechanism, and the key action mechanism drives the associated hammer for rotation. The hammer strikes the associated strings at the given final hammer velocity, and produces the acoustic sound. The loudness of the acoustic sound is proportional to the final hammer velocity, and the acoustic sound has the loudness equal to that of the acoustic sound in the original performance. When the interpreter 32 produces the piece of music data information MC representative of an instruction for releasing the depressed key 6*a*/6*b*, the interpreter 32 supplies the driving control signal CTL1 representative of the target released key velocity to the associated driving means 34 at the key release timing, and the driving means 34 changes the driving signal DR to the given magnitude, and the depressed black/white key 6*a*/6*b* returns to the rest position at the given released key velocity.

When the piece of music data information MMC is interpreted, the interpreter 32 regulates the driving control signal CTL1 to the value corresponding to the magnitude modified by the information processor 23 as described hereinbefore. The driving means 34 regulates the driving pulse signal DR to the modified magnitude, and the solenoid-operated key actuator 5 quickly moves the black/white key 6*a*/6*b* to the certain position where the solenoid-operated key actuator 5 depresses the black/white key 6*a*/6*b*, again. For this reason, the repetition is faithfully reproduced in the playback, and any acoustic sound is never missing.

As will be understood from the foregoing description, the information processor 23 modifies the target released key velocity to an appropriate value to depress the black/white key on the way toward the rest position, and the pieces of modified music data information MMC representative of the modified target released key velocity are stored in the memory means 31 together with the pieces of music data information representative of the instructions for depressing and releasing the black/white keys 6*a*/6*b*. For this reason, the automatic player piano faithfully reproduces an original performance.

The released key velocity estimator 21 implementing the second embodiment is not expected to process the pieces of music data information in the real time fashion, and it is not necessary to supply the pieces of music data information MC from and to the released key velocity estimator 21 in the order of executing the instructions. For this reason, all of the pieces of music data information may be stored in the information processor 23 so as to selectively modify the modified pieces of music data information MC' to the pieces of modified music data information MMC. Not only the random access memory but also a floppy disk and an opto-magnetic disk are available for the buffer in so far as the pieces of stored information are selectively rewritable.

The released key velocity determiner 21 may take the impact timing and the final hammer velocity into account so as to determine the target released key velocity. In this instance, the information processor 23 may be deleted from the released key velocity estimator 19.

The pieces of modified music data information MMC and the pieces of music data information MC may be stored in the memory means 31 through an on-line data communication or an off-line data communication using a floppy disk or an opto-magnetic disk.

Information Storage Medium for Storing Relation and Program Used in Controller The relation between the final hammer velocities ONVEL, the time interval GT and the released key velocity OFFVEL, which is hereinbelow referred to as "relational data", may be stored in an information storage medium such as a compact hard disk or a read only memory unit together with the programmed instructions. A random access memory device, CD-ROM (Compact Disk Read Only Memory), a floppy disk and an opto-magnetic disk are used as a portable information storage medium. The relation data and the programmed instructions are installed from these portable information storage medium to a hard-disk incorporated in a computer system. For this reason, the portable information storage medium is desirable for version-up.

The relational data and the programmed instructions may be supplied from a provider to a hard-disk incorporated in the controller through a communication network. Followings are an example of down-load through the communication network.

The controller has a communication interface connected to a communication network such as LAN (Local Area Network), Internet or Telecommunication line, and is connectable through the communication network to a server computer. In this instance, the controller equipped with the released key velocity controller and the server computer form a client-server system. If the relational data and the program have not been stored in the hard-disk, the controller sends a command representative of the down-load to the server computer, and the server computer responds to the command so as to supply the relational data and the programmed instructions to the controller through the communication network. The controller stores the relational data and the programmed instructions into the hard-disk, and the down-load is completed.

The controller may be implemented by a personal computer system sold in the market. The relational data and the programmed instructions may be supplied to the personal computer system through the portable information storage medium or the communication network or stored in a non-volatile memory such as a read only memory before delivery to user.

As will be appreciated from the foregoing description, the released key velocity estimator according to the present invention determines a target released key velocity on the basis of other key-touch factors, and supplements the target key-velocity to the pieces of music data information MC. The solenoid-operated key actuator controls the released black/white key 6*a*/6*b* to return toward the rest position at the target released key velocity, and the key-motion is faithfully reproduced in the playback.

Although particular embodiments of the present invention have been shown and described, it will be obvious to those skilled in the art that various changes and modifications may be made without departing from the spirit and scope of the present invention.

The relations between the final hammer velocity ONVEL, the time interval GT and the target released key velocity OFFVEL may be grouped by a style of rendition or the combinations of the rendition and the field.

The released key velocity estimator may be incorporated in an electronic keyboard musical instrument for changing an attribute of electronic sounds in response to the released key velocity.

What is claimed is:

1. A keyboard musical instrument controlled with pieces of music data information, said keyboard musical instrument including a released key velocity estimator comprising:

a memory storing a predetermined relation between released key velocity and other key-touch factors including at least one key-touch factor relating to the striking of a string for generating a sound; and a released key velocity determiner connected to said memory and supplying pieces of data information representative of said other key-touch factors to said memory, wherein a released key velocity corresponding to values of said other key-touch factors is read out from said memory.

2. The keyboard musical instrument as set forth in claim 1, in which said keyboard musical instrument further includes a plurality of keys selectively moved between respective rest positions and respective end positions to produce acoustic sounds, a plurality of key actuators associated with said plurality of keys, respectively, and responsive to a driving signal for selectively moving said plurality of keys between said rest positions and said end positions, and a driving unit connected to said plurality of key actuators and regulating said driving signal to a target magnitude for controlling a depressed key velocity toward said end positions and said released key velocity toward said rest positions, wherein said released key velocity estimator is connected to said driving unit so as to supply said pieces of music data information thereto.

3. The released key velocity estimator as set forth in claim 2, in which said keyboard musical instrument is an acoustic piano.

4. The released key velocity estimator as set forth in claim 1, further comprising a modifying means connected to said released key velocity determiner and modifying one of said pieces of music data information so as to associate a released key with said read out released key velocity.

5. A method for estimating a released key velocity in a keyboard musical instrument comprising the steps of:

preparing in an information storage medium a relation between released key velocity and other key-touch factors including at least one key-touch factor relating to the striking of a string for generating a sound; and supplying a piece of control data information representative of said other key-touch factors for a key to said information storage medium so as to estimate released key velocity for the key.

6. An information storage medium storing a program sequence for estimating a released key velocity of a key incorporated in a keyboard musical instrument on the basis of a relation between released key velocity and other key-touch factors including at least one key-touch factor relating to the striking of a string for generating a sound, said other factors being contained in supplied pieces of music data information.

* * * * *